US009996038B2

(12) United States Patent
Okumura

(10) Patent No.: US 9,996,038 B2
(45) Date of Patent: Jun. 12, 2018

(54) IMAGE FORMING APPARATUS

(71) Applicant: CANON KABUSHIKI KAISHA, Tokyo (JP)

(72) Inventor: Shohei Okumura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/622,565

(22) Filed: Jun. 14, 2017

(65) Prior Publication Data

US 2017/0364012 A1 Dec. 21, 2017

(30) Foreign Application Priority Data

Jun. 17, 2016 (JP) ..... 2016-121097

(51) Int. Cl.
*G03G 15/00* (2006.01)
*G03G 15/16* (2006.01)
*G03G 15/10* (2006.01)

(52) U.S. Cl.
CPC ..... *G03G 15/5029* (2013.01); *G03G 15/10* (2013.01); *G03G 15/16* (2013.01)

(58) Field of Classification Search
CPC .... G03G 15/10; G03G 15/104; G03G 15/105; G03G 15/16; G03G 15/5029
See application file for complete search history.

(56) References Cited

U.S. PATENT DOCUMENTS 6,735,408 B2 5/2004 Yoshino et al.
6,738,592 B2 5/2004 Sasaki et al.
6,865,359 B2 3/2005 Sasaki et al.
6,999,701 B2 2/2006 Yoshino et al.
7,039,343 B2 5/2006 Sasaki et al.
(Continued)

FOREIGN PATENT DOCUMENTS

EP 0 997 792 A1 5/2000
JP 8-152788 A 6/1996
JP 2003-091161 A 3/2003
(Continued)

OTHER PUBLICATIONS

Extended European Search Report dated Dec. 4, 2017, in European Patent Application No. 17174924.5.
U.S. Appl. No. 15/611,113, Shohei Okumura, filed Jun. 1, 2017.

*Primary Examiner* — David M Gray
*Assistant Examiner* — Andrew V Do
(74) *Attorney, Agent, or Firm* — Fitzpatrick, Cella, Harper & Scinto

(57) ABSTRACT

An image forming apparatus includes an image bearing member configured to bear a toner image formed using a liquid developer containing toner particles and a carrier liquid, a transfer member, an input portion into which information on a kind of a recording material is inputted, an adjusting device configured to adjust an amount of the carrier liquid of the toner image, and an executing portion configured to execute an operation of the adjusting device depending on the information when the toner image is in the adjusting position. The executing position executes either of a plurality of operations including a first operation in which the amount of the carrier liquid of the toner image is increased, a second operation in which the amount of the carrier liquid is decreased, and a third operation in which the amount of the carrier liquid is not adjusted.

13 Claims, 5 Drawing Sheets

(56) References Cited

U.S. PATENT DOCUMENTS

2007/0047985 A1* 3/2007 Kamijo ..... G03G 15/105
399/45

FOREIGN PATENT DOCUMENTS

| | | | |
|---|---|---|---|
| JP | 2007-171404 | A | 7/2007 |
| JP | 2013-033095 | A | 2/2013 |
| JP | 2013-109153 | A | 6/2013 |

* cited by examiner

IMAGE FORMING APPARATUS

FIELD OF THE INVENTION AND RELATED ART

The present invention relates to an image forming apparatus of an electrophotographic type, and particularly relates to an image forming apparatus using a liquid developer in which toner particles are dispersed in a carrier liquid.

Conventionally, the image forming apparatus of the electrophotographic type has been widely used as a copying machine, a printer, a plotter, a facsimile machine, a multifunction machine having a plurality of functions of these machines, or the like. As the image forming apparatus of the electrophotographic type, an image forming apparatus in which a toner image is formed on an image bearing member with the liquid developer containing the toner particles and the carrier liquid and then is transferred onto a recording material such as recording paper has been known.

In the image forming apparatus using such a liquid developer, it has been known that a proportion (ratio) of the toner contained in the liquid developer largely influences an image quality. In the following, the proportion of the toner contained in the liquid developer is referred to as T/D (ratio) and is represented by a mass fraction (%). In general, viscosity of the liquid developer increases with T/D, and a toner migration speed in the liquid developer under application of a bias is strongly influenced by a viscosity resistance. For this reason, by the influence of the viscosity resistance, the toner migration speed in a liquid developer with a high T/D is slower than the toner migration speed in a liquid developer with a low T/D. For this reason, in the liquid developer with the high T/D in which the viscosity is high, there is a possibility of causing a problem of a lowering in image density or the like due to an insufficient movement amount of the toner particles. On the other hand, in the liquid developer with the low T/D in which the viscosity is low, due to a positional deviation of the toner generated by a flow of the liquid developer in which the toner particles are moved, there is a possibility of generation of an image defect such as a flow of the toner image.

In the image forming apparatus using such a liquid developer, the image defect generates in some cases due to a value of a penetration speed of the carrier liquid into the recording material. For example, as regards the recording material high in carrier liquid penetration speed, carrier liquid penetration generates to a high degree at a transfer portion onto the recording material, so that a so-called transfer void such that the toner is not completely transferred onto the recording material is liable to generate due to a lowering in toner movement amount with the increased T/D. On the other hand, as regards the recording material low in carrier liquid penetration speed, an excessive carrier liquid remains on the recording material while being in a state in which T/D is a low value, so that the image defect such as a flow, a blur, spreading, thickening of a thin line, or the like of the toner image occurs. That is, an optimum T/D for transfer varies depending on the kind of the recording material, and therefore, there is a need to optimize a liquid amount of the carrier liquid at the transfer portion onto the recording material.

In the image forming apparatus using such a liquid developer, as disclosed in Japanese Laid-Open Patent Application (JP-A) 2003-91161, a technique such that not only a means for adjusting T/D is provided but also a removal amount of the excessive carrier liquid is adjusted so as not to disturb the toner image formed on the image bearing member has been known. In this image forming apparatus, a layer (film) thickness of the liquid developer deposited on the surface of a photosensitive drum is appropriately regulated by adjusting a contact pressure of a sweep roller contactable to the photosensitive drum, so that the removal amount of the carrier liquid can be adjusted.

However, in the image forming apparatus disclosed in JP-A 2003-91161, the excessive carrier liquid can only be removed for adjusting the liquid amount of the carrier liquid of the liquid developer at the transfer portion onto the recording material. That is, the carrier liquid does not increase, and therefore, for example, even when shortage of the carrier liquid generates at the transfer portion for the recording material high in carrier liquid penetration speed, the image forming apparatus cannot deal with the carrier liquid shortage.

SUMMARY OF THE INVENTION

According to an aspect of the present invention, there is provided an image forming apparatus comprising: an image bearing member movable in a predetermined movement direction and configured to bear a toner image formed at an image forming position by using a liquid developer containing toner particles and a carrier liquid; a transfer member configured to transfer the toner image onto a recording material at a transfer portion formed between itself and the image bearing member; an input portion into which information on a kind of the recording material onto which the toner image is transferred is inputted; an adjusting device configured to adjust an amount of the carrier liquid of the toner image on the image bearing member, wherein the adjusting device is provided at an adjusting position opposing a position of the image bearing member upstream of the transfer portion and downstream of the image forming position with respect to the movement direction and includes a carrier liquid container configured to store the carrier liquid, a rotatable adjusting roller configured to carry the carrier liquid stored in the carrier liquid container, and a contacting-and-spacing mechanism movable between a contact position where the adjusting roller is contacted to the image bearing member and a spaced position where the adjusting roller is spaced from the image bearing member; and an executing portion configured to execute an operation of the adjusting device depending on the information inputted in the input portion when the toner image on the image bearing member is in the adjusting position, wherein the executing portion executes either of a plurality of operations including a first operation in which the amount of the carrier liquid of the toner image on the image bearing member is increased by the adjusting device, a second operation in which the amount of the carrier liquid is decreased by the adjusting device, and a third operation in which the amount of the carrier liquid is not adjusted by the adjusting device.

Further features of the present invention will become apparent from the following description of exemplary embodiments with reference to the attached drawings.

DESCRIPTION OF EMBODIMENTS

In the following, an embodiment of the present invention will be described with reference to FIGS. 1-6. An image forming apparatus 1 in this embodiment is a digital printer of an electrophotographic type in which a toner image formed with a liquid developer containing toner particles and a carrier liquid C is formed (transferred) on a recording material.

The liquid developer used in this embodiment is a liquid developer in which the toner particles are dispersed in the carrier liquid. The toner particles are negatively chargeable resin particles of 0.1-2.0 μm in average diameter, in which a colorant and a binder are a main component and a charge-assisting agent or the like is added. The carrier liquid C is a non-volatile liquid having a high resistance and low dielectric constant, and is $1.0\times10^{10}$ Ω.cm or more in volume resistivity, 10 or less in relative dielectric constant, and 1-100 cP in viscosity. As the carrier liquid C, a carrier liquid prepared by adding a charge control agent or the like into an insulative carrier such as silicone oil, mineral oil, Isopar M (registered trademark, manufactured by Exxon Mobil Corp.) is usable. Further, also a photo-curable liquid monomer is usable when the liquid monomer satisfies the above-described physical properties. In this embodiment, the above-described toner particles and carrier liquid are mixed and adjusted to provide a T/D (mass fraction of the toner contained in the liquid developer) of 1-15%, and a resultant mixture is used as the liquid developer. Incidentally, also a liquid developer having viscosity exceeding 100 cP is usable in principle, but a load of liquid feeding increases, and therefore, in this embodiment, a liquid developer having relatively low viscosity is used, and the viscosity of the liquid developer is increased together with T/D in a concentration step described later.

Figure 1:
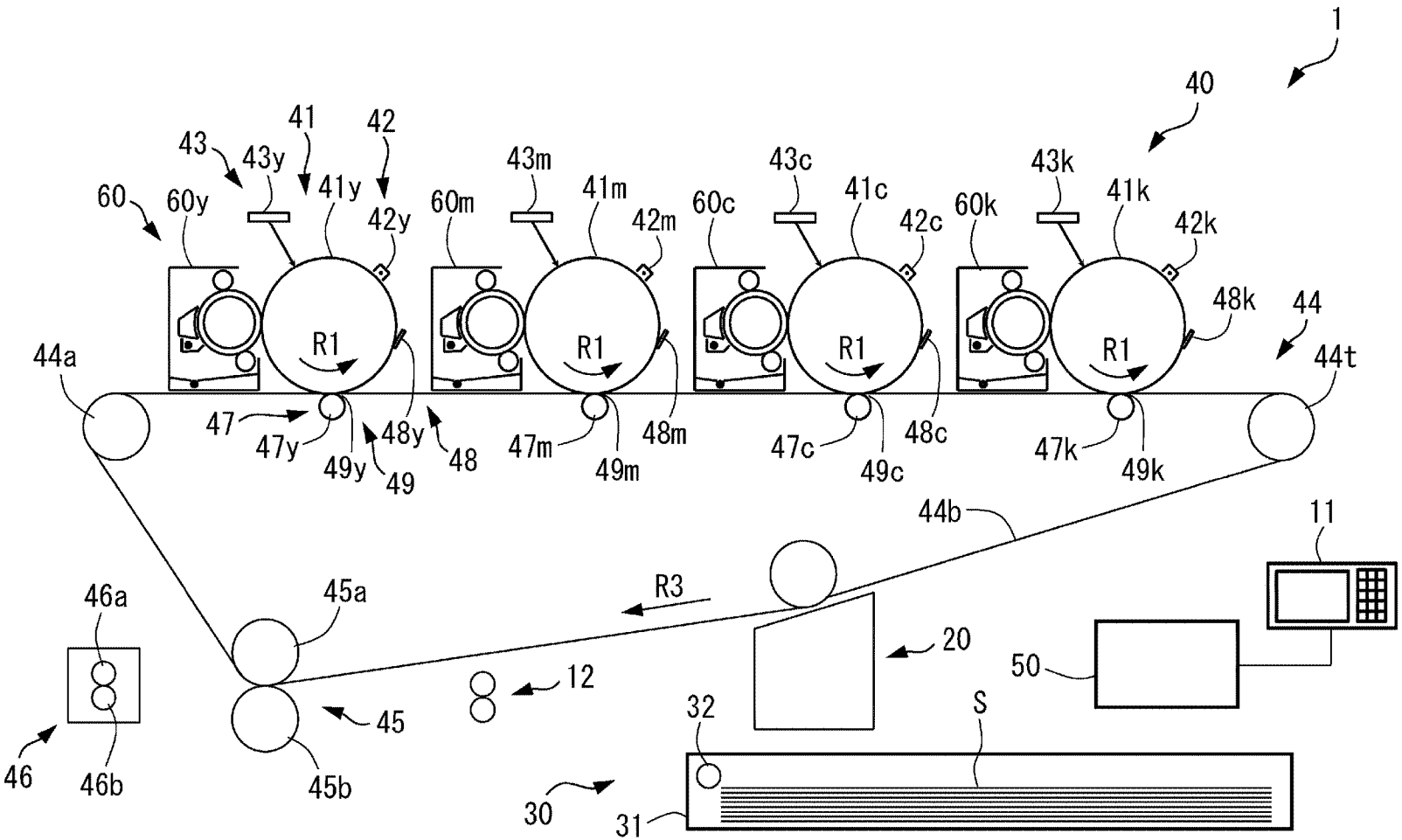
FIG. 1 is a schematic sectional view of an image forming apparatus according to an embodiment of the present invention.

As shown in FIG. 1, the image forming apparatus 1 includes a sheet feeding portion 30, an image forming portion 40, an adjusting device (adjusting means) 20, a controller 50 and an operating portion 11. Incidentally, on a sheet S which is a recording material, a toner image is to be formed, and specific examples of the sheet S include plain paper, coated paper coated with a coating agent at a surface thereof, thick paper, a sheet for an overhead projector (OHT (overhead transparency) sheet), and the like.

The image forming apparatus 1 operates on the basis of an image signal, and transfers the toner image formed on the image forming portion 40 onto the sheet S as the recording material successively fed (conveyed) from a sheet cassette 31, and thereafter the toner image is fixed on the sheet S and thus an image is obtained. The image signal is sent to the image forming apparatus 1 from an unshown external terminal such as a scanner or a personal computer.

The sheet feeding portion 30 includes the sheet cassette 31 for stacking and accommodating sheets such as recording paper and includes a feeding roller 32, and feeds the accommodated sheet S to the image forming portion 40.

The image forming portion 40 includes a photosensitive drum (photosensitive member) 41, a charger 42, a laser exposure device 43, a developing device 60, an intermediary transfer unit 44, a secondary transfer portion 45, a fixing device 46 and a cleaning device 48. The image forming portion 40 is capable of forming the image on the sheet S on the basis of image information. Incidentally, the image forming apparatus 1 in this embodiment is capable of forming a full-color image and includes the photosensitive drums 41*y* for yellow (y), 41*m* for magenta (m), 41*c* for cyan (c) and 41*k* for black (k), which have the same constitution and which are provided separately. This is true for the chargers 42*y*, 42*m*, 42*c* and 42*k*, the laser exposure devices 43*y*, 43*m*, 43*c* and 43*k*, the developing devices 60*y*, 60*m*, 60*c* and 60*k*, primary transfer rollers 47*y*, 47*m*, 47*c* and 47*k*, and the cleaning devices 48*y*, 48*m*, 48*c* and 48*k*. For this reason, in FIG. 1, respective constituent elements for four colors are shown by adding associated color identifiers to associated reference numerals, but in FIG. 2 and in the specification, the constituent elements are described using only the reference numerals without adding the color identifier in some cases.

Figure 2:
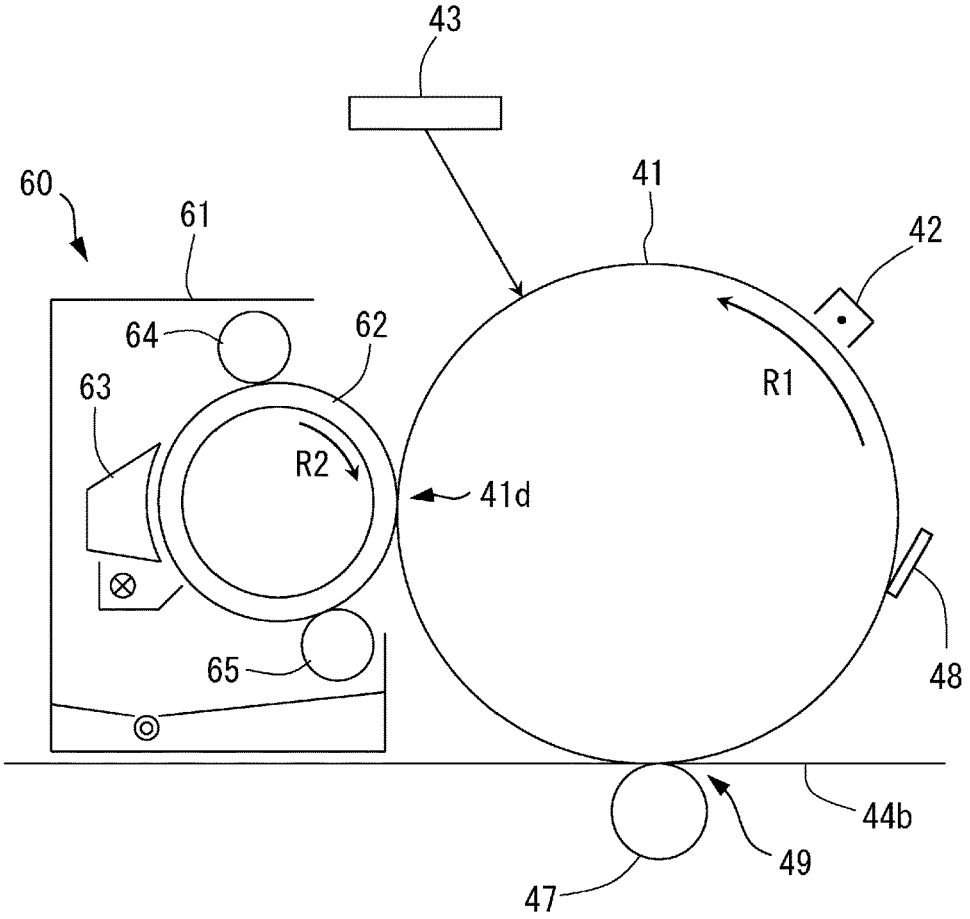
FIG. 2 is a schematic sectional view of a principal part of the image forming apparatus in the embodiment.

As shown in FIG. 2, the photosensitive drum 41 is a drum-shaped electrophotographic photosensitive member, and is rotated in an arrow R1 direction in FIG. 1 by an unshown drum motor, so that the photosensitive drum 41 is circulated and moved while carrying an electrostatic latent image formed on the basis of image information during image formation. The photosensitive drum 41 is movable while carrying the toner image formed with the liquid developer at a developing portion 41*d* through development of the electrostatic latent image.

The charger 42 is disposed substantially parallel to a center axis of the photosensitive drum 41 and electrically charges uniformly a surface of the photosensitive drum 41 to a dark-portion potential Vd of the same polarity as a charge polarity of the toner. In this embodiment, as the toner, a negatively chargeable toner is used, and therefore, the dark-portion potential Vd has a negative value. Further, as the charger 42, a corona charger is used. However, the charger 42 is not limited to the corona charger, but a charging roller or the like may also be used as the charger 42.

The laser exposure device 43 exposes the surface of the photosensitive drum 41 charged to the dark-portion potential to laser light emitted in a side downstream of the charger 42 with respect to the R1 direction and thus causes potential drop at an exposure portion, so that the electrostatic latent image is formed on the surface of the photosensitive drum 41. The potential at the exposure portion when the voltage drop is caused at the exposure portion is a light-portion potential Vl.

The developing device 60 is disposed downstream of the laser exposure device 43 with respect to the R1 direction, and is provided in contact with the photosensitive drum 41. The developing device 60 includes a developing container 61, a developing roller (developer carrying member) 62, a developing electrode 63, a squeeze roller ((liquid) amount-reducing means) 64, and a cleaning roller 65. The developing container 61 accommodates the developing roller 62, the developing electrode 63, the squeeze roller 64, and the cleaning roller 65, and the liquid developer is supplied from an unshown mixer.

The developing roller 62 includes a metal shaft and an elastic layer of an electroconductive rubber formed around the metal shaft, and contacts the photosensitive drum 41 at a contact portion with predetermined pressure, so that a developing portion 41*d* is formed. The developing roller 62 is supplied with a predetermined developing bias by an unshown voltage source and is rotationally driven in an arrow R2 direction by an unshown driving means so that a surface speed thereof is substantially equal to a surface speed of the photosensitive drum 41. The developing roller 62 is capable of supplying the liquid developer to the photosensitive drum 41, and develops the electrostatic latent image, on the surface of the photosensitive drum 41, with the toner at the developing portion 41*d*. To a gap between the developing roller 62 and the developing electrode 63, the liquid developer in which T/D is adjusted in advance by an unshown mixer is supplied by an unshown supplying means, so that the liquid developer in the neighborhood of the surface of the developing roller 62 is fed by rotation of the developing roller 62 while being carried on the surface of the developing roller 62.

The developing electrode 63 is disposed opposed to the developing roller 62 and is provided so that a bias of the same polarity as the charge polarity of the toner is applicable to the developing roller 62. By the rotation of the developing roller 62 in the R2 direction, the liquid developer carried on the developing roller 62 passes through between the developing electrode 63 and the developing roller 62. At this time, by the application of the bias to the developing electrode 63, the toner in the liquid developer between the developing electrode 63 and the developing roller 62 electrophoretically moves toward the surface of the developing roller 62 and is fed to a contact region, between the developing roller 62 and the squeeze roller 64, downstream of the developing electrode 63 with respect to the R2 direction. Incidentally, by adjusting a magnitude of the bias applied from the developing electrode 63 to the developing roller 62, T/D at the developing portion can be adjusted, and in addition, T/D at a secondary transfer portion 45 can be adjusted.

The squeeze roller 64 is pressed against the developing roller 62 by an unshown pressing means under application of a bias of the same polarity as the toner charge polarity to the developing roller 62, and is rotated by rotation of the developing roller 62. As a result, the layer thickness of the liquid developer on the surface of the developing roller 62 is regulated so as to be substantially uniform and T/D of the liquid developer increases up to 25-40%, so that the liquid developer is concentrated (concentration step). In this embodiment, the layer thickness of the liquid developer passing through between the developing roller 62 and the squeeze roller 64 is determined on the basis of Young's modulus, liquid developer viscosity and a process concentration. For this reason, by adjusting pressure at which the squeeze roller 64 is pressed against the developing roller 62, the layer thickness of the liquid developer reaching the developing portion 41*d* can be adjusted. Incidentally, a toner amount per unit area can be adjusted depending on a magnitude of a bias from the developing electrode 63.

The liquid developer which cannot pass through between the developing roller 62 and the squeeze roller 64 and which is pushed back passes through an upper portion of the developing electrode 63 and is returned to the mixer by an unshown discharging means. That is, the squeeze roller 64 is capable of decreasing the liquid amount of the carrier liquid C deposited on the developing roller 62.

The liquid developer concentrated through the concentration step is supplied to the electrostatic latent image on the photosensitive drum 41 by the rotation of the developing roller 62, so that the electrostatic latent image is developed into the toner image (developing step). At this time, T/D of the toner image on the photosensitive drum 41 at an image portion increases compared with T/D of the liquid developer immediately after the concentration step, and is 30-45%. This is because in the developing step, in order to develop the electrostatic latent image at the image portion by the developing roller 62, most of the toner and a part of the carrier liquid C move to the photosensitive drum 41, but the carrier liquid C in a certain amount remains on the developing roller 62. A similar phenomenon can generate also in a primary transfer step, a secondary transfer step and T/D control which are described later.

The cleaning roller 65 is disposed downstream of the developing portion 41*d* with respect to the R2 direction, and is provided by being pressed against the developing roller 62 by an unshown pressing means. The cleaning roller 65 removes the liquid developer remaining on the surface of the developing roller 62 after the development by applying the bias of the opposite polarity to the toner charge polarity to the developing roller 62. The removed liquid developer is returned to the mixer by the discharging means.

As shown in FIG. 1, the intermediary transfer unit 44 includes a plurality of rollers including a driving roller 44*a*, a tension roller 44*t* and the primary transfer rollers 47*y*, 47*m*, 47*c* and 47*k* and includes the intermediary transfer belt (image bearing member) 55*b* wound around these rollers. The primary transfer rollers 47*y*, 47*m*, 47*c* and 47*k* are disposed opposed to the photosensitive drums 41*y*, 41*m*, 41*c* and 41*k*, respectively. The respective primary transfer rollers 47 are urged toward the respective photosensitive drums 41 so as to sandwich the intermediary transfer belt 44*b* therebetween by an unshown pressing (urging) means, so that primary transfer portions 49*y*, 49*m*, 49*c* and 49*k* are formed.

The cleaning device 48 is disposed downstream of the primary transfer portion of the photosensitive drum 41 with respect to the R1 direction, and removes the liquid developer remaining on the surface of the photosensitive drum 41 after the primary transfer. The removed liquid developer is fed to an unshown separating means by an unshown feeding means and is separated into the carrier liquid C and a high-density (concentration) liquid developer, and thereafter the carrier liquid C is fed to a recycling carrier tank (container) and the high-density liquid developer is fed to a residual (waste) liquid tank (container).

The intermediary transfer belt 44*b* is constituted by adding therein a resistance-adjusting agent such as carbon black and is $1.0\times10^{9}$-$1.0\times10^{13}$ Ω.cm in volume resistivity. On the intermediary transfer belt 44*b*, a certain tension or more is exerted also when the intermediary transfer belt 44*b* is not driven, and the intermediary transfer belt 44*b* is not spaced from the photosensitive drums 41*y*, 41*m*, 41*c* and 41*k* but always contacts these photosensitive drums. By applying a positive transfer bias to the intermediary transfer belt 44*b* through the primary transfer rollers 47*y*, 47*m*, 47*c* and 47*k*, negative toner images on the photosensitive drums 41*y*, 41*m*, 41*c* and 41*k* are multiple-transferred successively onto the intermediary transfer belt 44*b*. As a result, the intermediary transfer belt 44*b* on which a full-color toner image obtained by developing the electrostatic latent images on the surfaces of the photosensitive drums 41*y*, 41*m*, 41*c* and 41*k* is transferred moves. By applying the bias of the opposite polarity to the toner charge polarity to the primary transfer rollers 41, the toner images are transferred from the photosensitive drums 41 onto the intermediary transfer belt 44*b* (primary transfer step). At this time, T/D of the toner image on the intermediary transfer belt 44*b* at the image portion increases compared with T/D of the liquid developer immediately after the developing step and is 35-50%. That is, under application of the transfer bias, the toner images formed on the photosensitive drums 41 are transferred onto the intermediary transfer belt 44*b* at the primary transfer portions 49, and the intermediary transfer belt 44*b* is movable while carrying the toner images.

The toner images transferred superposedly onto the intermediary transfer belt 44*b* at the primary transfer portions 49*y*, 49*m*, 49*c* and 49*k* pass through the adjusting device and are fed to the secondary transfer portion 45. That is, the adjusting device 20 is disposed in a liquid developer feeding path from the primary transfer portions 49 to the secondary transfer portion 45. Details of the adjusting device 20 will be described later.

The secondary transfer portion 45 includes an inner secondary transfer roller 45*a* and an outer secondary transfer roller (secondary transfer means) 45*b* which contact the intermediary transfer belt 44*b* while opposing each other. Between the outer secondary transfer roller 45*b* and the intermediary transfer belt 44*b*, the sheet S fed from a registration roller pair 12 is nipped and fed. By applying a positive secondary transfer bias to the outer secondary transfer roller 45*b*, the full-color image formed on the intermediary transfer belt 44*b* is transferred onto the sheet S. At this time, T/D of the toner image on the sheet S as the image portion increases compared with T/D of the liquid developer immediately after the primary transfer step, and is 40-55%. That is, the outer secondary transfer roller 45*b* forms the secondary transfer portion 45 where the toner images are transferred from the intermediary transfer belt 44*b* onto the sheet S under application of the transfer bias.

In a side downstream of the secondary transfer portion 45 on the intermediary transfer belt 44*b* with respect to an R3 direction, an unshown intermediary transfer belt cleaning device is provided and removes the developer remaining on the surface of the intermediary transfer belt 44*b* after the secondary transfer. The removed liquid developer is fed to a separating means by an unshown feeding means.

The fixing device 46 includes a fixing roller 46*a* and a pressing roller 46*b*. The sheet S is nipped and fed between the fixing roller 46*a* and the pressing roller 46*b*, whereby the toner image transferred on the sheet S is heated and pressed and is fixed on the sheet S.

The operating portion 11 is an operating panel including operating buttons and a display portion and is connected to the controller 50. Through the operating portion 11, by an operation by a user, for example, in addition to the sheet kind, a copying sheet number, enlargement, reduction, both-side/one-side printing, color/monochromatic printing, a cassette for feeding the sheet, a sheet size and the like are settable for the controller 50.

Figure 3:
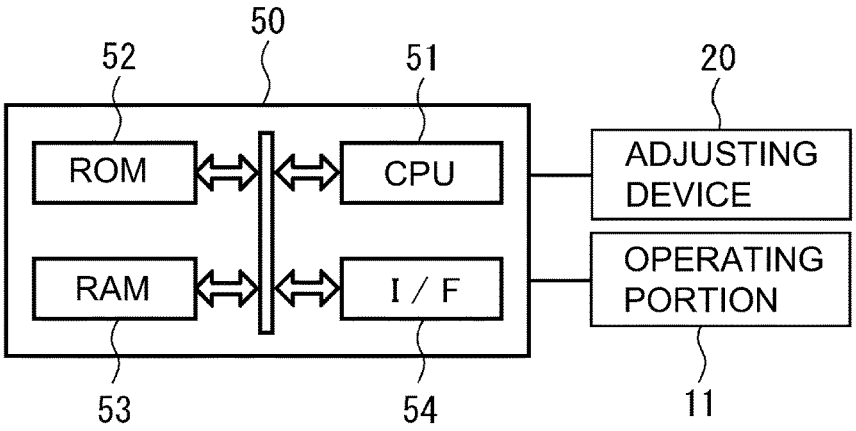
FIG. 3 is a schematic black diagram showing a connection relationship of a controller of the image forming apparatus in the embodiment.

As shown in FIG. 3, the controller 50 is constituted by a computer and includes, for example, a CPU 51, a ROM 52 for storing a program for controlling the respective portions, a RAM 53 for temporarily storing data, and an input/output circuit (I/F) 54 through which signals are inputted from and outputted into an external device. The controller 50 is connected with the operating portion 11, the adjusting device 20, the sheet feeding portion 30 and the image forming portion 40 via the input/output circuit 54 and not only transfers signals with the respective portions but also controls operations of the respective portions. Details of an operation of the controller 50 will be described later.

Next, the image forming operation of the image forming apparatus 1 constituted as described above will be described.

When an image forming job signal is inputted into the controller 50, the image forming operation is started, and the photosensitive drum 41 is rotated and the surface thereof is electrically charged by the charger 42. Then, on the basis of the image information, the laser light is emitted from the laser exposure device 43 to the photosensitive drum 41, so that the electrostatic latent image is formed on the surface of the photosensitive drum 41. The toner is deposited on this electrostatic latent image, whereby the electrostatic latent image is developed and visualized as the toner image and then the toner image is primary-transferred onto the intermediary transfer belt 44*b*.

On the other hand, the feeding roller 32 rotates in parallel to such a toner image forming operation and feeds an uppermost sheet S on the sheet cassette 31 to the registration roller pair 12 while separating the sheet S and the sheet S is once stopped at the registration roller pair 12. Then, the sheet S is conveyed to the secondary transfer portion 45 by being timed to the toner image on the intermediary transfer belt 44*b*. The sheet S supplied to the secondary transfer portion 45 is nipped and conveyed by the intermediary transfer belt 44*b* and the outer secondary transfer roller 45*b*. The sheet S on which the toner image is transferred at the secondary transfer portion 45 is conveyed to the fixing device 46, in which the unfixed toner image is heated and pressed and thus is fixed on the surface of the sheet S, and then the sheet S is discharged.

Next, a constitution of the adjusting device 20 of the image forming apparatus 1 in this embodiment will be described specifically with reference to FIG. 4.

The adjusting device 20 is provided at a position opposing a position of the intermediary transfer belt 44*b* between the primary transfer portion 49 and the secondary transfer portion 45 (FIG. 1). The adjusting device 20 includes a carrier liquid container (tank) 21, a supplying roller (second roller) 22, a supplying roller regulating blade 23, an adjusting roller (first roller) 24, an adjusting roller regulating blade 25, a high-voltage source 26 and an opposite roller 27.

The carrier liquid container 21 is a storing container (tank) which opens upwardly, and is positioned under the supplying roller 22 and the adjusting roller 24. Inside the carrier liquid container 21, the carrier liquid C is stored. The carrier liquid container 21 is connected to the recycling carrier tank and is supplied with the carrier liquid C as desired from the recycling carrier tank. Above a liquid surface of the stored carrier liquid C, a liquid surface sensor 21*s* is provided. The liquid surface sensor 21*s* is connected to the controller 50, and on the basis of a detection result of the liquid surface sensor 21*s*, the controller 50 controls supply of the carrier liquid C from the recycling carrier tank so that a detected liquid surface height of the carrier liquid C falls within a predetermined range. In this embodiment, as the liquid surface sensor 21*s*, an ultrasonic sensor is used, and the liquid surface height is detected by a reflection time of ultrasonic wave with which the liquid surface of the carrier liquid C is irradiated. However, the liquid surface sensor 21*s* is not limited to the ultrasonic sensor.

Figure 4:
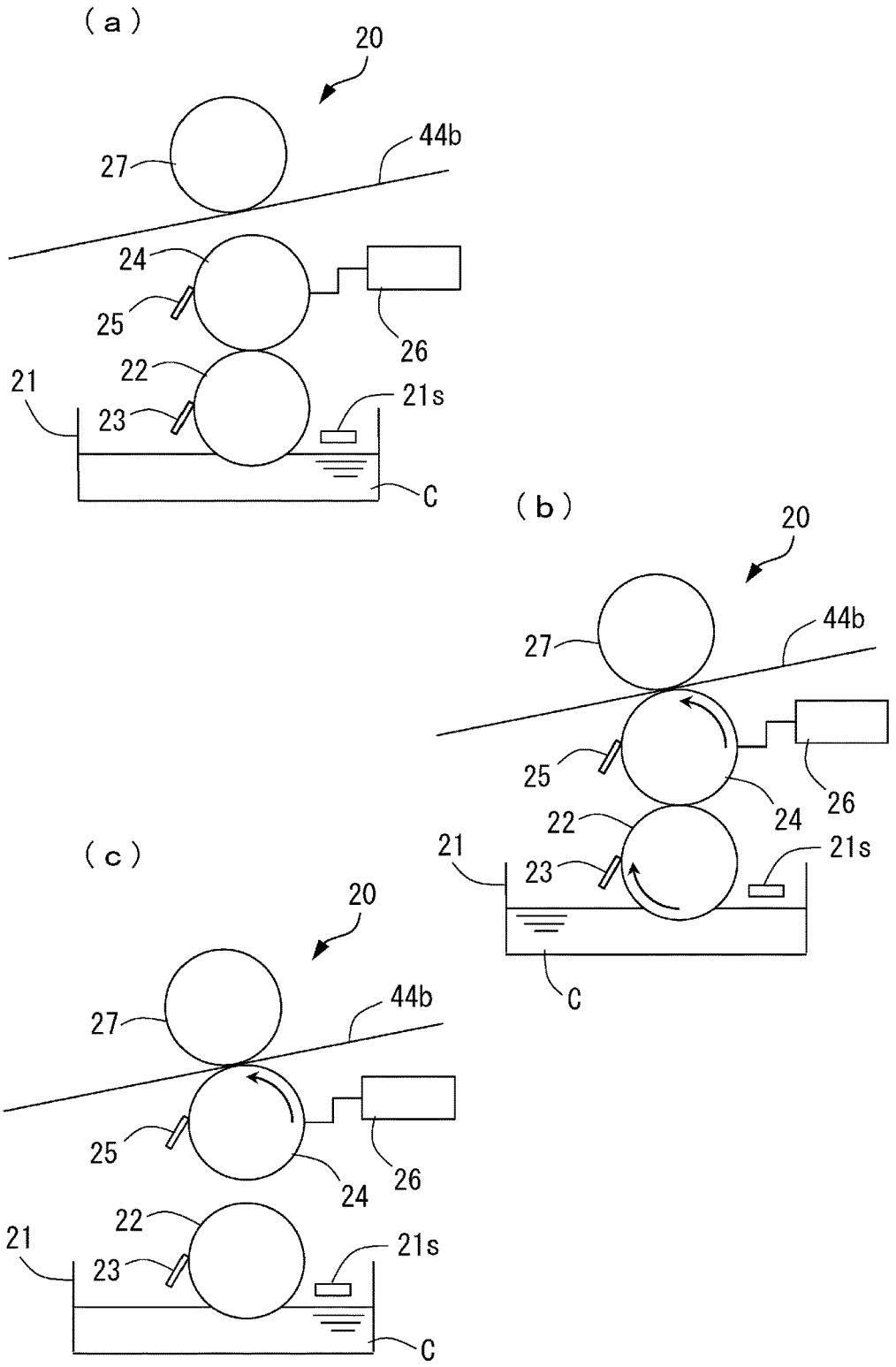
In FIG. 4, (a) to (c) are schematic sectional views each showing an operation mode of an adjusting device of the image forming apparatus in the embodiment, in which (a) shows a normal mode, (b) shows a carrier impartation mode, and (c) shows a carrier removal mode.

The supplying roller 22 is positioned above the carrier liquid container 21 and under the adjusting roller 24, and is rotationally driven in an arrow direction shown in (b) of FIG. 4 by an unshown driving means. That is, the supplying roller 22 is interposed between the adjusting roller 24 and the carrier liquid C stored in the carrier liquid container 21.

Further, the carrier 22 is capable of being raised and lowered in a vertical (up-down) direction by an unshown raising and lowering means, and a contact and spaced state thereof relative to the adjusting roller 24 can be switched depending on an operating mode. That is, the supplying roller 22 is relatively placeable between a contact state in which the supplying roller 22 simultaneously contacts the carrier liquid C and the adjusting roller 24 and a spaced state in which the supplying roller 22 is spaced from at least one of the carrier liquid C and the adjusting roller 24. In this embodiment, the supplying roller 22 is rotatably supported at the same position relative to the carrier liquid container 21 so as to always contact the carrier liquid C stored in the carrier liquid container 21.

The supplying roller 22 includes a core metal and an elastic layer formed at a periphery of the core metal. In this embodiment, a material of the elastic layer is an urethane rubber and has a volume resistivity of $1.0\times10^{11}$ Ω.cm or more, a JIS-A hardness of 30-50 degrees and a surface roughness Rz of 2 μm or less. Incidentally, in the case where there is no liability of generation of swelling by the carrier liquid C, a fluctuation in physical values described above, a fluctuation in physical values of the carrier liquid C and another deterioration, it is also possible to use materials other than the above-described material.

The supplying roller regulating blade 23 is supported at a fixed position relative to the supplying roller 22 so as to contact the surface of the supplying roller 22 with predetermined contact pressure. As a result, a thickness of the carrier liquid C on the supplying roller 22 is regulated uniformly to a predetermined value, so that an excessive carrier liquid C drops into the carrier liquid container 21. Incidentally, the contact pressure of the supplying roller regulating blade 23 is set so that the thickness of the carrier liquid C on the supplying roller 22 after being regulated by the supplying roller regulating blade 23 is 6-20 μm. Further, as shown in (a) and (b) of FIG. 4, in a state in which the supplying roller 22 also contacts the adjusting roller 24, in a nip formed by the supplying roller 22 and the adjusting roller 24, about ½ of an amount of the carrier C on the supplying roller 22 is transferred from the supplying roller 22 onto the adjusting roller 24. As a result, a thickness of the carrier liquid C on the adjusting roller 24 is 3-10 μm.

In this embodiment, the thickness of the carrier liquid C supplied to the adjusting roller 24 is controlled using the supplying roller 22 and the supplying roller regulating blade 23, but the control means is not limited thereto. For example, if the thickness of the carrier liquid C is uniformly controllable, means such as a roller pair or anilox roller may also be used.

The adjusting roller 24 is positioned on the supplying roller 22 and is rotationally driven in an arrow direction shown in (b) of FIG. 4 by an unshown driving means, and a bias of the same polarity as the toner charge polarity is applicable to the adjusting roller 24 by the high-voltage source 26 connected to the adjusting roller 24. In this embodiment, as the adjusting roller 24, a roller formed of SUS alloy and having the surface roughness Rz of 0.2-2.0 μm is used. The adjusting roller 24 is capable of being raised and lowered in the vertical direction by an unshown raising and lowering means, and depending on an operating mode, a contact and spaced state thereof relative to the supplying roller 22 or the intermediary transfer belt **44*b* is switched. As a result, an impartation and removal operation of the carrier liquid C relative to the toner image on the intermediary transfer belt 44*b* is switched. That is, the adjusting roller 24 not only contacts the liquid developer feeding path but also is capable of carrying the carrier liquid C stored in the carrier liquid container 21. Incidentally, the adjusting roller regulating blade 25 is provided in contact with the adjusting roller 24 and removes the carrier liquid C remaining on the surface of the adjusting roller 24**.

Next, respective operation modes in operations of the adjusting device 20 of the image forming apparatus 1 in this embodiment will be described specifically with reference to FIG. 4. As shown in (a), (b) and (c) of FIG. 4, the operation mode of the adjusting device 20 is switchable among three operation modes including a normal mode ((a) of FIG. 4), a carrier impartation mode ((b) of FIG. 4) and a carrier removal mode ((c) of FIG. 4).

As shown in (a) of FIG. 4, in the operation in the normal mode, the adjusting roller 24 is spaced from the intermediary transfer belt **44*b*, so that not only supply of the carrier liquid C to the intermediary transfer belt 44*b* but also removal of the carrier liquid C from the intermediary transfer belt 44*b*** are not carried out.

For this reason, T/D of the toner image on the intermediary transfer belt **44*b*** at the image portion is substantially unchanged from T/D immediately after the primary transfer step, and is 35-50%.

As shown in (b) of FIG. 4, in the operation in the carrier impartation mode, the adjusting roller 24 simultaneously contacts the intermediary transfer belt **44*b* and the supplying roller 22, and the supplying roller 22 simultaneously contacts the adjusting roller 24 and the carrier liquid C. The carrier liquid C is drawn up from the carrier liquid container 21 by the supplying roller 22, is supplied to the adjusting roller 24, and then is supplied from the adjusting roller 24 to the intermediary transfer belt 44*b*. At this time, by the bias, of the same polarity as the toner charge polarity, applied to the adjusting roller 24, the toner on the intermediary transfer belt 44*b* is not moved to the adjusting roller 24 but is still carried on the intermediary transfer belt 44*b*, so that only the carrier liquid C is increased in amount. That is, the adjusting device 20 is capable of at least increasing the liquid amount of the carrier liquid C of the liquid developer fed in the liquid developer feeding path from the developing portion 41*d* to the secondary transfer portion 45. As a result, T/D of the toner image on the intermediary transfer belt 44*b* at the image portion decreases compared with T/D immediately after the primary transfer step, and is 30-45%. The carrier liquid C remaining on the adjusting roller 24 after being supplied to the intermediary transfer belt 44*b* is removed by the adjusting roller regulating blade 25 and drops into the carrier liquid container 21**.

As shown in (c) of FIG. 4, in the operation in the carrier removal mode, the adjusting roller 24 contacts the intermediary transfer belt **44*b* and is spaced from the supplying roller 22. At a nip formed by the adjusting roller 24 and the intermediary transfer belt 44*b*, a part of the carrier liquid C on the intermediary transfer belt 44*b* is transferred (moved) from the intermediary transfer belt 44*b* onto the adjusting roller 24. At this time, by the bias, of the same polarity as the toner charge polarity, applied to the adjusting roller 24, the toner on the intermediary transfer belt 44*b* is not moved to the adjusting roller 24 but is still carried on the intermediary transfer belt 44*b*, so that only the carrier liquid C is decreased in amount. That is, the adjusting device 20 is capable of decreasing the liquid amount of the carrier liquid C of the fed liquid developer. As a result, T/D of the toner image on the intermediary transfer belt 44*b* at the image portion increases compared with T/D immediately after the primary transfer step, and is 40-55%. The carrier liquid C remaining on the adjusting roller 24 after being removed from the intermediary transfer belt 44***b* is removed by the adjusting roller regulating blade 25 and drops into the carrier liquid container 21.

Figure 6:
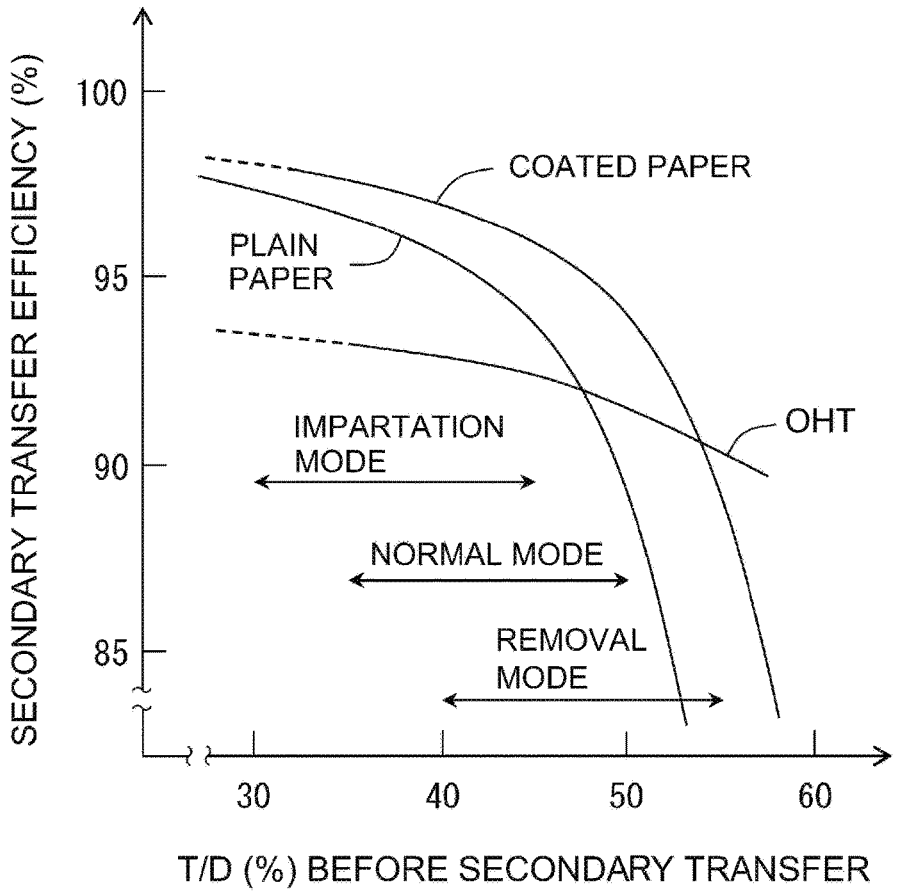
FIG. 6 is a graph showing, for each sheet kind, a relationship between T/D before secondary transfer and a secondary transfer efficiency in the image forming apparatus in the embodiment.

Here, control of T/D at the image portion of the toner image on the intermediary transfer belt 44*b* before secondary transfer for each of sheets different in kind will be described on the basis of FIG. 6. Incidentally, in this case, T/D before secondary transfer is T/D when the toner image is fed to the secondary transfer portion 45, and means T/D at a portion from the primary transfer portions to the secondary transfer portion and does not contain T/D at a portion upstream of the primary transfer portions. In FIG. 6, a relationship between T/D (T/D before secondary transfer) at the portion from the primary transfer portions to the secondary transfer portion and second transfer efficiency. Here, the second transfer efficiency means a proportion of the toner, of the toner on the intermediary transfer belt 44*b* after the primary transfer step and before the secondary transfer step, moved on the sheet by the secondary transfer. Further, in FIG. 6, not only plain paper as an example of high-penetration media having a penetration speed higher than that of coated paper but also an OHT surface as an example of non-penetrative media having a penetration speed lower than that of the coated paper are shown together with the coated paper, but the sheet kind is not limited thereto.

As shown in FIG. 6, in the case where comparison is made at the same T/D, the second transfer efficiency of the plain paper is lower than the second transfer efficiency of the coated paper. Further, at a relatively low T/D (about 45% or less), the second transfer efficiency of the OHT sheet is lower than the second transfer efficiency of the coated paper and the second transfer efficiency of the plain paper, but when T/D is increased (about 50% or more), this relationship is reversed. Further, in the case of the coated paper and the OHT sheet, although the second transfer efficiency does not lower at a low T/D, an image defect such as a flow of the toner can generate in some cases (broken line portions). The flow of the toner is more noticeable in the case of the OHT sheet than in the case of the coated paper, and there is a tendency that the flow of the toner generates also at a higher T/D.

In the image forming apparatus 1 in this embodiment, the T/D before secondary transfer in the case where the liquid amount adjustment control is not carried out is 35-50%. As shown in FIG. 6, in a range of T/D=35-50%, as regards the coated paper, the second transfer efficiency of 90% or more can be obtained. On the other hand, as regards the plain paper, in the range of T/D=35-50%, the second transfer efficiency lowers when compared with the coated paper and is below 90% in the neighborhood of T/D=50%. Further, as regards the OHT sheet, in the range of T/D=35-50%, although the second transfer efficiency of 90% or more is obtained, the image defect such as the flow of the toner generates in the neighborhood of T/D=35%.

The above-described tendency can be explained on the basis of a magnitude of the carrier penetration speed into the sheet. That is, the penetration speed of the carrier liquid C into the plain paper is higher than that into the coated paper, and therefore, at the secondary transfer portion 45, an increase degree of T/D of the image portion of the toner image is large, so that a transfer void due to a lowering in toner mobility is liable to generate. On the other hand, as regards the OHT sheet, the penetration of the carrier liquid C into the sheet generates little, and therefore, due to a flow of an excessive carrier liquid C, a positional deviation of toner particles on the sheet is liable to generate, so that the image defect such as the flow of the toner is liable to generate.

In this embodiment, in order to optimize the secondary transfer step depending on the carrier penetration speed for each of the above-described sheets, adjustment of T/D is carried out depending on the sheet by the adjusting device 20. That is, as regards the sheet such as the plain paper having the carrier penetration speed higher than that of the coated paper, in order to avoid the lowering in second transfer efficiency at the high T/D, the T/D before secondary transfer may preferably be decreased compared with the case of the coated paper. Further, as regards the sheet such as the OHT sheet into which the carrier liquid little penetrates, in order to avoid the toner image flow at the low T/D, the T/D before secondary transfer may preferably be increased compared with the case of the coated paper.

Specifically, the controller 50 sets the operation mode of the adjusting device 20 at the normal mode for the coated paper, the carrier impartation mode for the plain paper and the carrier removal mode for the OHT sheet. Incidentally, in this embodiment, the three operation modes are employed, but the number of the operation modes is not limited to three. For example, in the case where a plurality of adjusting devices are used or in the like case, the operation mode may also be classified more specifically.

The controller 50 adjusts the liquid amount of the carrier liquid C at the secondary transfer portion on the basis of the kind of the sheet S, onto which the toner image is to be transferred, by using the adjusting device 20 and the squeeze roller 64. In the case where the liquid amount of the carrier liquid is increased in the liquid developer fed in the feeding path, the controller 50 causes the adjusting roller 24 to carry, on the surface of the adjusting roller 24, the carrier liquid C stored in the carrier liquid container 21, and is capable of executing the operation in the carrier impartation mode in which the carrier liquid C is supplied to the liquid developer fed in the feeding path. In the operation in the carrier impartation mode, the controller 50 places the supplying roller 22 in a contact state, so that the carrier liquid C stored in the carrier liquid container 21 is supplied to the surface of the adjusting roller 24 via the supplying roller 22 and is carried on the surface of the adjusting roller 24.

Further, in the case where the liquid amount of the carrier liquid is decreased in the liquid developer fed in the feeding path, the controller 50 does not cause the adjusting roller 24 to carry, on the surface of the adjusting roller 24, the carrier liquid C stored in the carrier liquid container 21. In this case, the controller 50 is capable of executing the operation in the carrier removal mode in which the carrier liquid C is removed by the adjusting roller 24 from the liquid developer fed in the feeding path. In the operation in the carrier removal mode, the controller 50 places the supplying roller 22 in a spaced state, so that the carrier liquid C stored in the carrier liquid container 21 is not carried on the surface of the adjusting roller 24. Incidentally, information on the operation modes corresponding to the respective sheet kinds and setting of states of the adjusting device 20 in the operations in the respective operation modes are stored in storing devices such as the ROM 52 and the RAM 53.

Figure 5:
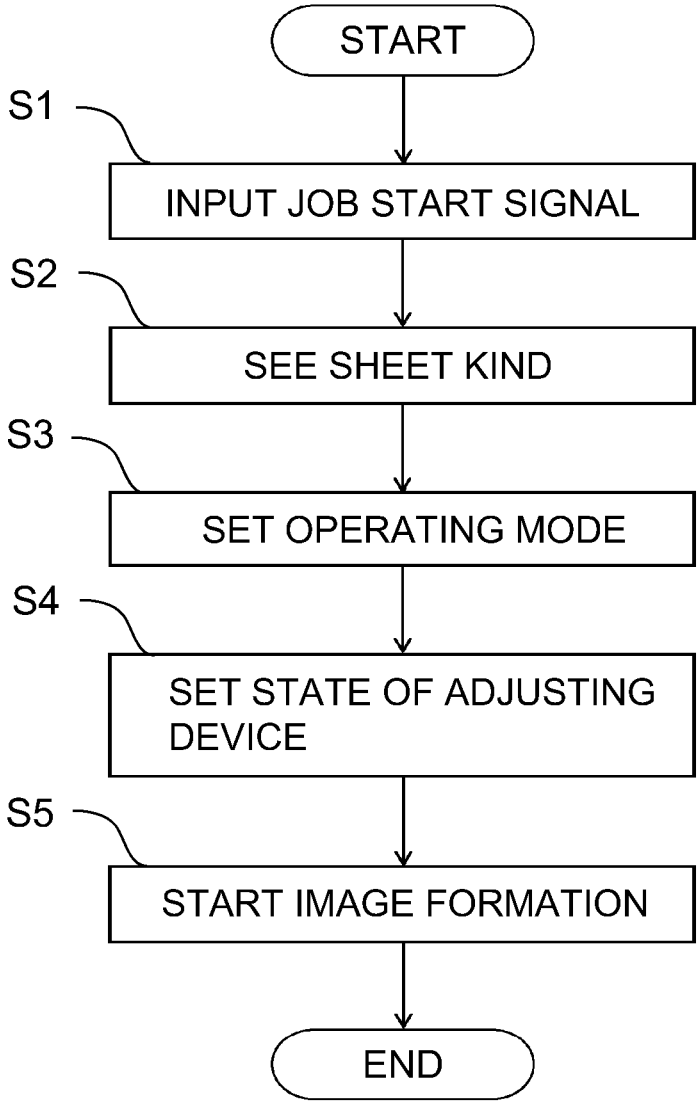
FIG. 5 is a flowchart showing a procedure such that in the image forming apparatus in the embodiment, an operation mode for adjusting a liquid amount of a carrier liquid is set depending on a sheet kind and then an image is formed.

Next, a procedure in which the operation mode for adjusting the liquid amount of the carrier liquid C at the secondary transfer portion 45 is set depending the sheet kind and then image formation is effected by the image forming apparatus 1 in this embodiment will be described along a flow chart shown in FIG. 5.

The user inputs the kind of the sheet, subjected to the image formation, through the operating portion 11 or the like in advance, and the inputted sheet kind is stored in the RAM 53. In this embodiment, the sheet kind is set by the user through the operating portion 11, but the present invention is not limited thereto. For example, the kind of the sheet staked in the sheet cassette 31 may also be detected using a sheet sensor for detecting surface roughness or the like of the sheet.

When the CPU 51 receives a print job start signal (step S1), the CPU 51 makes reference to the RAM 53 and reads the sheet kind (step S2). The CPU 51 sets the operation mode of the adjusting device 20 depending on the read sheet kind (step S3). In this embodiment, the CPU 51 sets the operation mode so that the operation mode is the normal mode when the sheet kind is the coated paper, the carrier impartation mode when the sheet kind is the plain paper, and the carrier removal mode when the sheet kind is the OHT sheet.

The CPU 51 sets a state of respective portions of the adjusting device 20 correspondingly to the operation mode (step S4). In this step, when the CPU 51 sets the normal mode, as shown in (a) of FIG. 4, the CPU 51 causes the adjusting roller 24 to be spaced from the intermediary transfer belt 44*b*. Further, when the CPU 51 sets the carrier impartation mode, as shown in (b) of FIG. 4, the CPU 51 places the supplying roller 22, the adjusting roller 24 and the intermediary transfer belt 44*b* in a contact state. Further, when the CPU 51 sets the carrier removal mode, as shown in (c) of FIG. 4, the CPU 51 causes the supplying roller 22 to be spaced from the adjusting roller 24 while keeping contact between the adjusting roller 24 and the intermediary transfer belt 44*b*. Then, the CPU 51 starts an image forming operation after completion of the setting of the state of the respective portions of the adjusting device 20 (step S5).

As described above, according to the image forming apparatus 1 in this embodiment, the controller 50 adjusts the liquid amount of the carrier liquid C at the secondary transfer portion 45 on the basis of the kind of the sheet S, onto which the toner image is to be transferred, by using the adjusting device 20 capable of increasing and decreasing the liquid amount of the carrier liquid C. For this reason, the adjusting device 20 can increase and decrease the liquid amount of the carrier liquid C, and therefore, as desired, the liquid amount of the carrier liquid C at the secondary transfer portion 45 can be increased and decreased. As a result, at the secondary transfer portion 45 to the sheet S, the liquid amount of the carrier liquid C can be adjusted to an appropriate amount, so that it becomes possible to compatibly realize suppression of the transfer void and the toner flow.

Further, according to the image forming apparatus 1 in this embodiment, the adjusting device 20 is disposed in the liquid developer feeding path from the primary transfer portions 49 to the secondary transfer portion 45. For this reason, the adjusting device 20 can replenish the carrier liquid C, decreased in amount at the developing portion 41*d* and the primary transfer portions 49, by increasing the carrier liquid C as desired. Further, the liquid amount of the carrier liquid C can be adjusted immediately in front of the secondary transfer portion 45, and therefore, for example, compared with the case where the adjusting device 20 is provided in the feeding path in a side upstream of the primary transfer portions 49, the liquid amount of the carrier liquid C can be adjusted with high accuracy.

Further, according to the image forming apparatus 1 in this embodiment, the developing device 60 includes the developing electrode 63 and the squeeze roller 64, and therefore, can decrease the liquid amount of the carrier liquid C, i.e., can concentrate the toner in the liquid developer, in a side upstream of the developing portion 41*d*. For this reason, the developing electrode 63 and the squeeze roller 64 can be effectively used in the case where T/D before secondary transfer is enhanced.

Further, according to the image forming apparatus 1 in this embodiment, the adjusting device 20 includes the supplying roller 22 and the adjusting roller 24, and the carrier liquid C carried on the supplying roller 22 is regulated by the supplying roller regulating blade 23 and the regulated carrier liquid C is carried on the adjusting roller 24. As a result, a layer having the layer (film) thickness of the carrier liquid C carried on the adjusting roller 24 can be formed as a very thin film of about 3-10 μm in thickness with high accuracy, for example. For this reason, compared with the case where the carrier liquid C is directly supplied to the adjusting roller 24 without using the supplying roller 22 and the layer thickness of the carrier liquid C is regulated by the supplying roller regulating blade, it is possible to easily realize the film formation with high accuracy.

Incidentally, in the image forming apparatus 1 in this embodiment, the case where the supplying roller regulating blade 23 is supported by the supplying roller 22 at a fixed relative position so as to contact the surface of the supplying roller 22 with predetermined contact pressure was described, but the present invention is not limited thereto. For example, the contact pressure of the supplying roller regulating blade 23 to the supplying roller 22 may also be made variable. In this case, the thickness of the carrier liquid C on the supplying roller 22 can be adjusted, so that the amount of the carrier liquid C supplied from the adjusting roller 24 to the intermediary transfer belt 44*b* is varied. For this reason, compared with the case where the contact pressure of the supplying roller regulating blade 23 is fixed, the amount of the carrier liquid C supplied to the toner image on the intermediary transfer belt 44*b* can be controlled. As a result, T/D before secondary transfer can be controlled for more sheet kinds.

In the image forming apparatus 1 in this embodiment, the case where only one adjusting device 20 is provided was described, but the present invention is not limited thereto. For example, two or more adjusting devices 20 may also be provided. In this case, compared with the case where only one adjusting device 20 is provided, the carrier liquid C in a larger amount can be removed from the toner image on the intermediary transfer belt 44*b*, so that the toner flow in the case of using a low-viscosity liquid developer can be effectively suppressed, for example.

In the image forming apparatus 1 in this embodiment, the case where the adjusting device 20 is disposed in the liquid developer feeding path from the primary transfer portions 49 to the secondary transfer portion 45 was described, but the present invention is not limited thereto. For example, the adjusting device 20 may also be disposed in the liquid developer feeding path from the developing portion 41*d* to the primary transfer portion 49.

In the image forming apparatus 1 in this embodiment, the case where the adjusting device 20 includes the supplying roller 22 and the adjusting roller 24 was described, but the present invention is not limited thereto. For example, without using the supplying roller 22, the carrier liquid C may also be directly supplied to the adjusting roller 24 and then may be regulated by the supplying roller regulating blade. Also in this case, at the secondary transfer portion 45 to the sheet S, the amount of the carrier liquid C can be adjusted to an appropriate amount in the case where excess and deficiency of the carrier liquid C generates, so that suppression of the transfer void and the toner flow can be realized compatibly.

In the image forming apparatus 1 in this embodiment, the case where the type in which the intermediary transfer belt

44*b* which is an intermediary transfer member is employed was described, but the present invention is not limited thereto. For example, a type in which the toner image is directly transferred from the photosensitive drum onto the sheet material may also be employed. In this case, the image forming apparatus includes the photosensitive drum (image bearing member), a transfer means, the adjusting device (adjusting means) and the controller. Further, the photosensitive drum is movable while carrying the toner image formed by developing the electrostatic latent image with the liquid developer at the developing portion. The transfer means forms a transfer portion where the toner image is transferred from the photosensitive drum onto the sheet under application of the transfer bias. The adjusting device is capable of at least increasing the liquid amount of the carrier liquid C of the liquid developer fed in the liquid developer feeding path in a region from the developing portion to the transfer portion. The controller adjusts the liquid amount of the carrier liquid C at the transfer portion on the basis of the kind of the sheet, onto which the toner image is transferred, by using the adjusting device. Also in this case, at the transfer portion where the toner image is transferred onto the sheet, the amount of the carrier liquid C can be adjusted to an appropriate amount in the case where excess and deficiency of the carrier liquid C generates, so that it becomes possible to compatibly realize the transfer void and the toner flow.

Embodiment

Using the image forming apparatus 1 in the above-described embodiment, images were formed on the plain paper, the coated paper and the OHT sheet. As the operation mode of the adjusting device 20, the carrier impartation mode was applied to the plain paper (T/D before secondary transfer: 30-45%), the normal mode was applied to the coated paper (T/D before secondary transfer: 35-50%), and the carrier removal mode was applied to the OHT sheet (T/D before secondary transfer: 40-50%). After the image formation, with respect to the formed images, degrees of the transfer void and the toner flow were checked. A result is shown in Table 1. As shown in Table 1, in this embodiment, with regards to the sheets of the three kinds, the second transfer efficiency was 90% or more, and no toner flow generated.

TABLE 1

| | EMB. AMS*4 | | CE1*1 NM*5 | | CE*2 CIM*6 | | CE*3 CRM*7 | |
|---|---|---|---|---|---|---|---|---|
| | TV*8 | TF*9 | TV*8 | TF*9 | TV*8 | TF*9 | TV*8 | TF*9 |
| PP*10 | ○ | ○ | x | ○ | ○ | ○ | x | ○ |
| CP*11 | ○ | ○ | ○ | ○ | ○ | x | x | ○ |
| OHT*12 | ○ | ○ | ○ | x | ○ | x | ○ | ○ |

*1"CE1" is Comparison Example 1.
*2"CE2" is Comparison Example 2.
*3"CE3" is Comparison Example 3.
*4"AMS" is all mode switching.
*5"NM" is the normal mode only.
*6"CIM" is the carrier impartation mode only.
*7"CRM" is the carrier removal mode only.
*8"TV" is the transfer void.
*9"TF" is the toner flow.
*10"PP" is the plain paper.
*11"CP" is the coated paper.
*12"OHT" is the OHT sheet.

In Table 1, "o" in evaluation of the transfer void represents the second transfer efficiency of 90% or more, and "x" in evaluation of the transfer void represents the second transfer efficiency of less than 90%. Further, "o" in evaluation of the toner flow represents that there was no image disturbance which can be recognized by visual observation, and "x" in evaluation of the toner flow represents that image disturbance which can be recognized by eye observation generated.

Comparison Example 1

In the image forming apparatus 1, the image formation was carried out in the operation only in the normal mode as the operation mode of the adjusting device 20 irrespective of the sheet kinds. A result is shown in Table 1. As shown in Table 1, the second transfer efficiency on the plain paper was less than 90%, and the toner flow generated on the OHT sheet.

Comparison Example 2

In the image forming apparatus 1, the image formation was carried out in the operation only in the carrier impartation mode as the operation mode of the adjusting device 20 irrespective of the sheet kinds. A result is shown in Table 1. As shown in Table 1, the toner flow generated on the coated paper and the OHT sheet.

Comparison Example 3

In the image forming apparatus 1, the image formation was carried out in the operation only in the carrier removal mode as the operation mode of the adjusting device 20 irrespective of the sheet kinds. A result is shown in Table 1. As shown in Table 1, the second transfer efficiency on the plain paper and the second transfer efficiency on the coated paper were less than 90%.

Accordingly, according to the image forming apparatus 1 in Embodiment, by appropriately switching the operation mode of the adjusting device 20 depending on the sheet kind, it was confirmed that suppression of the transfer void and the toner flow can be realized for the respective sheets.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-121097 filed on Jun. 17, 2016, which is hereby incorporated by reference herein in its entirety.

What is claimed is:

1. An image forming apparatus comprising:

an image bearing member movable in a predetermined movement direction and configured to bear a toner image formed at an image forming position by using a liquid developer containing toner particles and a carrier liquid;

a transfer member configured to transfer the toner image onto a recording material at a transfer portion formed between said transfer member and said image bearing member;

an input portion into which information on a kind of the recording material onto which the toner image is transferred is inputted;

an adjusting device configured to adjust an amount of the carrier liquid of the toner image on said image bearing member, wherein said adjusting device is provided at an adjusting position opposing a position of said image bearing member upstream of the transfer portion and downstream of the image forming position with respect to the movement direction and includes a carrier liquid container configured to store the carrier liquid, a rotatable adjusting roller configured to carry the carrier liquid stored in said carrier liquid container, and a contacting-and-spacing mechanism movable between a contact position where said adjusting roller is contacted to said image bearing member and a spaced position where said adjusting roller is spaced from said image bearing member; and an executing portion configured to execute an operation of said adjusting device depending on the information inputted in said input portion when the toner image on said image bearing member is at the adjusting position, wherein said executing portion executes any of a plurality of operations including a first operation in which the amount of the carrier liquid of the toner image on said image bearing member is increased by said adjusting device, a second operation in which the amount of the carrier liquid is decreased by said adjusting device, and a third operation in which the amount of the carrier liquid is not adjusted by said adjusting device.

2. The image forming apparatus according to claim 1, wherein said executing portion sets the amount of the carrier liquid, carried by said adjusting roller in the first operation, to a first amount, and sets the amount of the carrier liquid, carried by said adjusting roller in the second operation, to a second amount less than the first amount or at a state in which the carrier liquid is not carried.

3. The image forming apparatus according to claim 1, wherein said adjusting device includes a rotatable supplying roller configured to supply the carrier liquid to said adjusting roller while carrying the carrier liquid stored in said carrier liquid container, and wherein said executing portion moves said supplying roller to a contact position where said supplying roller simultaneously contacts both of said adjusting roller and the carrier liquid in the first operation, and moves said supplying roller to a spaced position where said supplying roller is spaced from at least one of said adjusting roller and the carrier liquid in the second operation.

4. The image forming apparatus according to claim 1, wherein said adjusting device includes an adjusting roller regulating member configured to regulate the amount of the carrier liquid carried by said adjusting roller.

5. The image forming apparatus according to claim 4, wherein said adjusting roller regulating member is a blade-shaped member.

6. The image forming apparatus according to claim 4, wherein said adjusting roller regulating member is a roller-shaped member.

7. The image forming apparatus according to claim 3, wherein said adjusting device includes a supplying roller regulating member configured to regulate the amount of the carrier liquid carried on said supplying roller.

8. The image forming apparatus according to claim 7, wherein said supplying roller regulating member is a blade-shaped member.

9. The image forming apparatus according to claim 7, wherein said supplying roller regulating member is a roller-shaped member.

10. The image forming apparatus according to claim 1, wherein said adjusting device includes a voltage source configured to apply a voltage, of the same polarity as a charge polarity of the toner, to said adjusting roller, and wherein said executing portion causes said voltage source to apply the voltage to said adjusting roller during execution of the first operation and the second operation.

11. The image forming apparatus according to claim 1, wherein when the information on the kind of the recording material indicates plain paper, said executing portion executes the first operation.

12. The image forming apparatus according to claim 1, wherein when the information on the kind of the recording material indicates an overhead transparency sheet, said executing portion executes the second operation.

13. The image forming apparatus according to claim 1, wherein when the information on the kind of the recording material indicates coated paper, said executing portion executes the third operation.

* * * * *